United States Patent [19]

Goto et al.

[11] 4,435,494

[45] Mar. 6, 1984

[54] PROCESS FOR DEPOSITING MAGNETIC TONER MATERIAL ON ELECTROSTATIC LATENT IMAGES

[75] Inventors: Ryuji Goto, Kumagaya; Keitaro Yamashita, Kodama; Koji Noguchi, Saitama, all of Japan

[73] Assignee: Hitachi Metals, Ltd., Japan

[21] Appl. No.: 355,255

[22] Filed: Mar. 5, 1982

[51] Int. Cl.[3] ..... G03G 13/09

[52] U.S. Cl. ..... 430/122; 118/657

[58] Field of Search ..... 430/122; 118/657

[56] References Cited

U.S. PATENT DOCUMENTS

| | | | |
|---|---|---|---|
| 4,292,387 | 9/1981 | Kanbe et al. | 430/122 X |
| 4,299,900 | 11/1981 | Mitsuhashi et al. | 430/122 |
| 4,309,498 | 1/1982 | Yamashita et al. | 430/122 X |
| 4,336,318 | 6/1982 | Fukumoto et al. | 430/122 X |

FOREIGN PATENT DOCUMENTS

| | | | |
|---|---|---|---|
| 55-133057 | 10/1980 | Japan | 430/122 |

*Primary Examiner*—Roland E. Martin, Jr.

*Attorney, Agent, or Firm*—Finnegan, Henderson, Farabow, Garrett & Dunner

[57] ABSTRACT

A process for depositing magnetic toner material on electrostatic latent images formed on an image bearing surfaces includes the steps of conveying toner to the developing zone via a magnet roll having a shell and coaxial permanent magnet member rotating in the same directions. In the region of the developing zone, the toner is subjected to both an A.C. magnetic field and an applied A.C. electrical field so as to render the toner electroconductive. The A.C. electrical field has a peak voltage greater than the dark voltage of the latent image, but less than 3,200 volts, and a frequency greater than v/0.3 where v is the advancing speed of the image bearing surfaces in relation to the magnet roll.

6 Claims, 4 Drawing Figures

PROCESS FOR DEPOSITING MAGNETIC TONER MATERIAL ON ELECTROSTATIC LATENT IMAGES

BACKGROUND OF THE INVENTION

This invention relates to electronic photography for developing electrostatic images formed on the surface of electrostatic latent image bearing material with magnetic toner having relatively high resistivity, transferring the developed images and then fixing the transferred images. In particular, it relates to a process suitable for developing latent images on the surface of electrostatic latent image bearing material conveyed at a relatively high speed.

Such electronic photography comprises forming electrostatic latent images on the photoconductive surface of a photosensitive material; developing such electrostatic latent images to form toner images; fixing the toner images directly or transferring the toner images to a transferring member; and then fixing the images to produce a copy. In such electronic photography, there has been employed a two component developer which is mixed powder of non-magnetic toner and powdery iron carrier with development being carried out by a magnetic brush. The magnetic brush developing process with a two component developer involves electrifying the toner to a predetermined polarity by frictional electricity with the carrier and selectively sticking the toner on the surface of electrostatic latent image bearing material. The process is advantageous in that the transference is easily performed, etc. However, the process necessitates mixing means for electrifying the toner and carrier by the friction and replenishing means for replacing toner consumed during the development for keeping the toner concentration uniform so that the developing apparatus becomes extensive and complicated. In addition, as the carrier becomes fatigued after being used for a predetermined period of time, the carrier should be exchanged.

In order to overcome such disadvantages, there has been introduced one component magnetic toner comprising essentially a resin and magnetic powder as a developer. Known developing processes using such magnetic toner include the process disclosed in U.S. Pat. No. 3,909,258. This process comprises bearing electroconductive magnetic toner on an electroconductive shell and forming an electroconductive circuit between the surface of electrostatic latent image bearing material and electroconductive shell by connecting electrically the rear surface of the electrosatic latent image bearing material and electroconductive shell to perform the development by electrostatic induction. However, such a developing process is disadvantageous in that when the developed toner images are transferred onto a transferring member, the transferred images are distorted by the disappearance of charge in the toner, introduction of charge from the transferring electrode or the like due to the electroconductivity of toner. Hence the process is suitable for so-called PPC process wherein a copy is produced by developing, transferring and fixing images.

In order to accomodate use of magnetic toner for the PPC process, there has been proposed a developing process using insulating toner having enhanced electrical resistivity. For example, U.S. Pat. No. 4,131,931 discloses that in order to enhance the developing performance of insulating magnetic toner, toner is contacted electrically with an electrode to be electrified forcedly and the electrified toner is conveyed at a high speed to the latent image surface to increase the developing current, thereby improving the developing performance. However by such a process, the high conveying speed of toner necessitates the rotation of a non-magnetic cylindrical shell at a relatively higher speed so that the used toner is subjected to a strong force at the gap between the flow rate controller plate set within a relatively narrow size and the shell to agglomerate the magnetic toner or to stick it firmly on the surface of shell.

In addition, U.S. Pat. No. 4,102,305 discloses a process for improving the developing performance as well as the transference performance in the PPC process. This developing process comprises using special toner showing electroconductivity in the presence of a high electric field and insulation in a low electric field, applying high electric field onto the toner particle within the developing zone to impart electroconductivity to them to effect the development; and transferring the toner particles to the transferring zone to effect the transference under the condition free from high electric field. This patent illustrates an embodiment applying a voltage having a peak-peak value of 20–100 V/μ(20,000—1,000,000 V/cm) and frequency of 500–5000 Hz by connecting an AC source to the non-magnetic cylinder for forming an AC electric field between the photoconductive surface and the cylinder. However, when such a high AC voltage is applied, there is high possibility of forming pinholes through the electrostatic latent image bearing surface by the discharge. In addition, there may occur failure in the development of the predetermined electrostatic latent images due to introducing a charge from the magnetic toner turned to be electroconductive at the vicinity of peak value of AC electric field onto the electrostatic latent image bearing surface. In addition, the developing gap is significantly wide, e.g. approximately 1.65 mm in an example in said patent specification. Such a wide gap may scatter the toner or may form an immobile layer at the vicinity of the cylindrical surface of the magnetic brush if relatively poorly fluidal toner is used for the PPC process or may form agglomeration of toner by the formation of such an immobile layer thereby presenting a high possibility of failure in the development. Hence, such a developing gap is unsuitable for electronic photographing apparatus necessitating high reliability for a long period of time.

SUMMARY OF THE INVENTION

It is thus a major object of this invention to overcome the disadvantages of the conventional art as set forth above and to provide a developing process assuring high reliability for a long period of time by taking into account of the stability of a magnetic brush for a long period of time by the rotation of the magnet relatively to the cylindrical shell incorporating the magnet and auxiliary electrical means. In other words, the main object of this invention is to provide an electostatic latent image developing process which assures high developing performance as well as high transferring performance in relatively high speed developments.

According to this invention, a process for depositing magnetic toner material on electrostatic latent images formed on an image bearing member comprises: providing a magnet roll adjacent to the image bearing member, the magnet roll including a cylindrical rotatable shell of non-magnetic material and a rotatable permanent magnet member positioned coaxially within the shell; supplying magnetic toner material onto the surface of the shell of the magnet roll; advancing the image bearing member in relation to the magnet roll; rotating both the shell and the permanent magnet in the same direction for advancing the magnetic toner material to a contacting area of the toner with the image bearing member; subjecting the magnetic toner on the contacting area to an A.C. magnetic field; and subjecting the magnetic toner on the contacting area to an A.C. electrical field to render the toner substantially conductive.

The permanent magnet may have a rotatable shaft mounted coaxially to the shell and a cylindrical permanent magnet secured to the shaft and the cylindrical permanent magnet may have a plurality of adjacent axially extending magnetic poles of alternating polarity on the peripheral surface thereof.

The frequency of the A.C. magnetic field due to rotation of the permanent magnet is more than one per millimeter of the advancing of the image bearing member in relation to the magnet roll. When magnetic toner having electric resistivity of $10^8$ to $10^{14}$ ohm.cm. in a D.C. electric field of 10,000 volts/cm is used, it is preferable that the frequency of the A.C. magnetic field is one to three per millimeter of the advancing of the image bearing member in relation to the magnet roll. When magnetic toner having electric resistivity of $10^{12}$ to $10^{16}$ ohm.cm in a D.C. electric field of 10,000 volts/cm is used, it is preferable that the frequency of the A.C. magnetic field is more than three per millimeter of the advancing of the image bearing member in relation to the magnet roll.

The peak voltage of the A.C. electrical field is more than the dark voltage of the latent images on the image bearing member. It is preferable that the peak voltage is more than 1.5 times the dark voltage of the latent image and less than 3,200 volts.

The frequency of the A.C. electrical field is 200 to 20,000 Hz. It is preferable that the frequency of the A.C. electrical field is more than v/0.3, wherein v is the advancing speed in millimeter/second of the image bearing member in relation to the magnet roll.

BRIEF DESCRIPTION OF THE DRAWINGS

This invention will be now illustrated in details by way of the attached drawings in which.

DESCRIPTION OF THE PREFERRED EMBODIMENT

Figure 1:
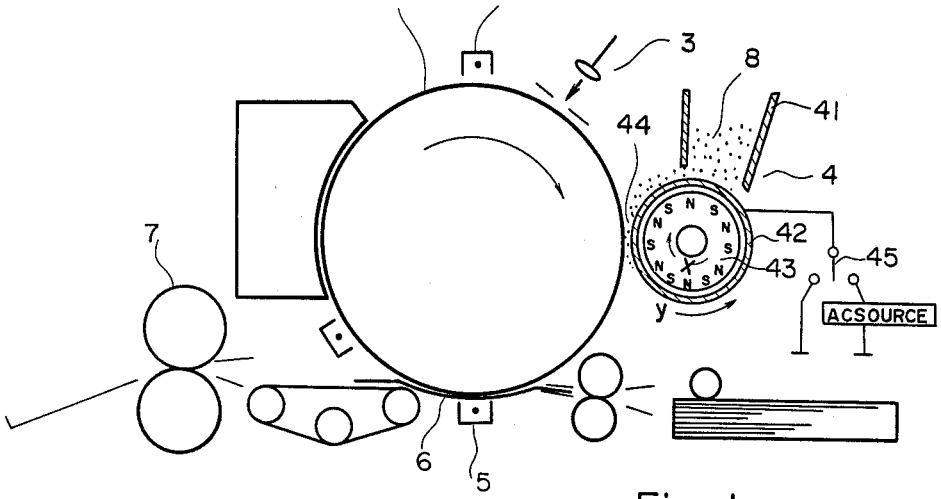
FIG. 1 is a schematic sectional view of an electronic copying apparatus for illustrating the process of the present invention.

FIG. 1 is a schematic sectional view of an electronic copying apparatus of the dry transferring type for illustrating the process of this invention for developing electrostatic latent images. In FIG. 1, the surface of a drum 1 of photosensitive material is charged uniformly by means of a corona electrifying means 2 and then irradiated with light by means of a light source 3 to form electrostatic latent images. The formed electrostatic latent images are developed by means of developing means 4 to form toner images on the surface of drum 1 of photosensitive material and said toner images are transferred electrostatically onto transferring paper 6 by means of corona discharging means 5. The transferred images are fixed by means of pressure fixing means 7 to provide a copy. In addition, developing means are provided with a hopper 41 for receiving magnetic toner 8 and a non-magnetic electroconductive cylindrical shell 42. A permanent magnet having a plurality of magnetic poles is mounted rotatably within non-magnetic shell 42. Non-magnetic shell 42 is grounded or connected to an AC power source via switch 45.

Both non-magnetic cylindrical shell 42 and magnet 43 are turned in the direction of x as indicated by an arrow in FIG. 1. The magnetic toner passed through the developing means 44 is conveyed to the direction of y as indicated by an arrow in FIG. 1 by setting the revolution of non-magnetic cylindrical shell 42 at a relatively low value and that of magnet 43 at a relatively higher value. Under the condition as set by such rotations, magnetic toner 8 which cannot be passed through developing means 44 is conveyed to the direction of x as indicated by an arrow in FIG. 1 with the rotation of non-magnetic cylindrical shell 42 to form a magnetic toner layer of a constant thickness along the surface of non-magnetic cylindrical shell 42 from the developing zone. The thickness of such a layer depends mainly on the revolution of non-magnetic cylindrical whell 42 and can maintain a substantially constant contacting width with respect to photosensitive material 1. Irrespective of the extremely narrow developing gap in developing means 44, the motion of the magnetic brush can follow the rotating magnetic field by means of rotating magnet 43 to provide advantageously constantly stabilized development and high developing performance. In an experiment employing the electronic copying apparatus as shown in FIG. 1, the revolution of magnet 43 was set at a value from 500 to 4,000 rpm. and that of non-magnetic cylindrical shell 42 at a value within the range of less than 1/20 of that for magnet 43, i.e. within the range from 25 to 80 rpm. The employed non-magnetic cylindrical shell 42 had an outer diameter of 31.4 mm, magnet 43 had an outer diameter of 29.3 mm and a cylindrical magnet was employed so that the magnetic force was 700 Gauses at the surface of non-magnetic cylindrical shell 42.

Figure 2:
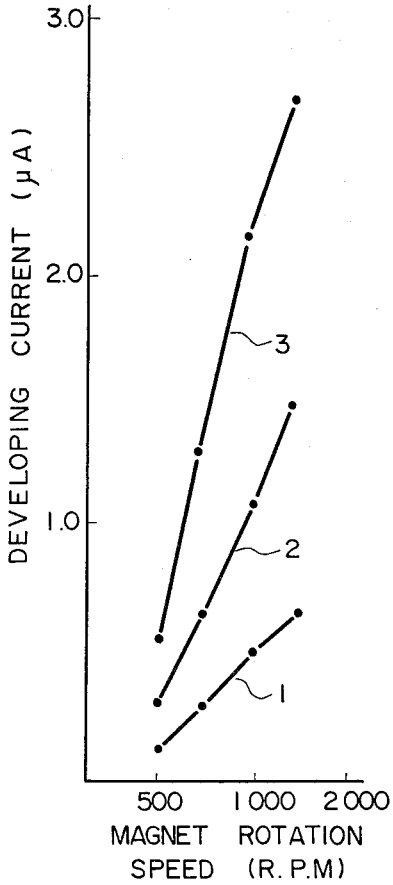
FIG. 2 is a graph showing developing current versus magnet rotation speed for the apparatus of FIG. 1.

In the experiment using magnetic toner having resistivity of $7\times10^{15}$, $7\times10^{14}$ or $8\times10^{11}$ ohm.cm under an electrical field of DC 10,000 V, setting the revolution of shell 42 at 20 rpm. and applying an electrical field of 8,000 V/cm, the developing current was measured. As shown in FIG. 2, the developing current was increased markedly with the increased rotating speed of the magnet. In FIG. 2, Curves 1, 2 and 3 show the developing current for the toner having resistivity of $7\times10^{15}$, $7\times10^{14}$ and $8\times10^{11}$ ohm.cm, respectively.

Figure 3:
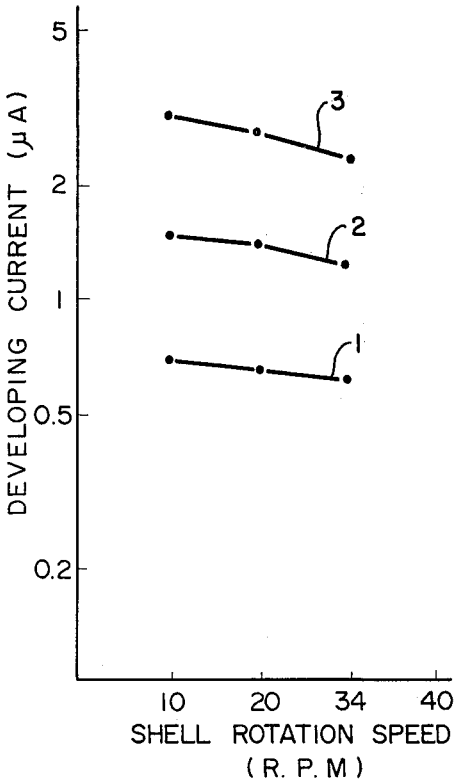
FIG. 3 is a graph showing developing current versus shell rotation speed for the apparatus of FIG. 1.

FIG. 3 shows the developing current when the rotation of magnet was set at 1,400 rpm. and the rotation speed of shell was varied. Curves 1, 2 and 3 are the developing current for the toner having resistivity of $7\times10^{15}$, $7\times10^{14}$ and $8\times10^{11}$ ohm.cm, respectively.

It is found from FIGS. 2 and 3 that the developing current is increased with increased rpm. of the magnet, but substantially independent of the rpm. of the shell.

The frequency of magnetic field in the developing zone is the product of rotating speed of magnet and the number of magnetic poles of magnet roll. Said frequency is desirably as high as possible but may be more than one per millimeter of the advancing of the image bearing member. For magnetic toner having resistivity ranging from $10^8$ to $10^{14}$ ohm.cm, the frequency should range from one to three per millimeter of the advancing of image bearing member. For magnetic toner having high resistivity from $10^{12}$ to $10^{16}$ ohm.cm under 10,000 DC volts/cm, the frequency should be higher than three per millimeter of the advancing of image bearing member.

Although the developing speed can be increased by increasing the revolution speed of the magnet, such an increase in the revolution of latter is restricted by reduction mechanism such as reduction gears, etc. so that the revolution speed is preferably less than 2,000 rpm.

Figure 4:
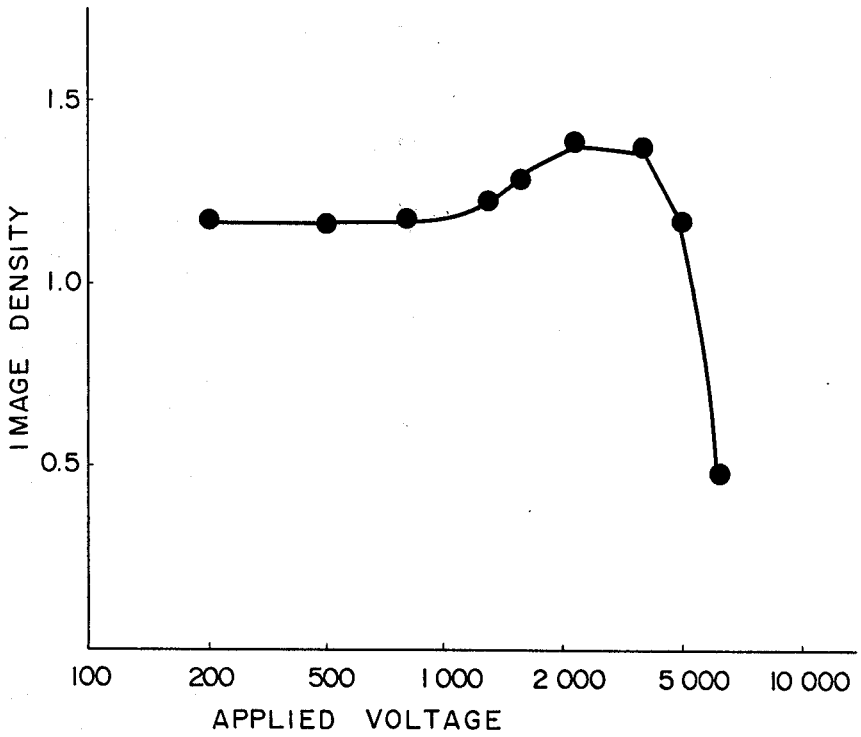
FIG. 4 is a graph showing image density versus applied voltage for the apparatus of FIG. 1.

FIG. 4 shows the concentration of images for magnetic toner having resistivity of higher than $10^{13}$ ohm.cm and the magnitude of the applied AC electrical field is varied. It may be seen from FIG. 4 that the image concentration is approximately 1.2 for a voltage up to about 800 volts, improves to approximately 1.35 for a voltage from 1,200 to 2,200 volts but decreases rapidly by applying a voltage of higher than 3,200 volts.

Such applied voltage should be higher than the dark voltage of latent image. The term "dark voltage" means the potential of the portions so the latent image not exposed to light.

If the applied potential is approximately 1.5 times the dark voltage, the images becomes extremely clear.

Such clearness of the images probably results from the fact that as the transference of charge in the magnetic brush on the shell is carried out efficiently at the vicinity of peak for the magnitude of electrical field in relation to the electrostatic latent image, the magnetic toner particles in contact with the electrostatic latent images are charged with high follow-up, while such decrease in the image concentration by the excessively high peak value probably results from the fact that as the magnetic toner has been turned from the insulating to the electroconductivity, the charge is introduced rapidly into the magnetic brush and also into the electrostatic latent image surface due to the high electrical field formed between the electrostatic latent image bearing material and the shell. Hence, it is unnecessary to make the insulating magnetic toner electroconductive by increasing the voltage of AC bias. The peak-peak value of AC voltage applied to the shell, V ranges preferably within the range of $$1.5Us \leqq V < 3{,}200 \text{ volts}$$

wherein Us is the dark voltage of electrostatic latent image.

The frequency of the AC electrical field is preferably as high as possible, but taking into account the developing speed, the frequency will be sufficiently v/0.3 Hz wherein v represents the advancing speed of the image bearing member.

What is claimed is:

1. A process for depositing single component magnetic toner material on electrostatic latent images formed on an image bearing member and characterized by a dark voltage, comprising the steps of:

Providing a magnet roll adjacent the image bearing member, the magnet roll including a cylindrical rotatable shell of non-magnetic material and a rotatable permanent magnet member positioned coaxially within the shell, the rotatable permanent magnet member having on its outer periphery a plurality of magnetic poles of alternating polarity;

supplying magnetic toner material onto the surface of the shell of the magnet roll;

rotationally advancing the image bearing member in relation to the magnet roll;

rotating both the shell and the permanent magnet in the same direction to form an A.C. magnetic field for advancing the magnetic toner material to a contacting area with the image bearing member, the A.C. magnetic field having a frequency of greater than one per millimeter of the advancing of the image bearing member in relation to the magnet roll;

subjecting the magnetic toner material in the contacting area to the A.C. magnetic field; and subjecting the magnetic toner material in the contacting area to an A.C. electrical field to render the toner substantially conductive, said A.C. electrical field having a peak voltage which is greater than the dark voltage of the latent images but less than 3,200 volts and having a frequency which is greater than v/0.3 where v is the advancing speed in millimeter/second of the image bearing member in relation to the magnet roll.

2. The process as set forth in claim 1, wherein the permanent magnet member has a rotatable shaft mounted coaxially to the shell and a cylindrical permanent magnet secured to the shaft, the cylindrical permanent magnet having a plurality of adjacent axially extending magnetic poles of alternating polarity on the peripheral surface thereof.

3. The process as set forth in claim 1, wherein the magnetic toner has an electric resistivity of at least $10^8$ ohm.cm in a D.C. electrical field of 10,000 volts/cm, and the frequency of the A.C. magnetic field is one to three per millimeter of the advancing of the image bearing member in relation to the magnet roll.

4. The process as set forth in claim 1 wherein the magnetic toner has an electrical resistivity of $10^{12}$ to $10^{16}$ ohm.cm in a D.C. electrical field of 10,000 volts/cm, and the frequency of the A.C. magnetic field is more than three per millimeter of the advancing of the image bearing member in relation to the magnet roll.

5. The process as set forth in claim 1, wherein the peak voltage of the A.C. electrical field is 1.5 times dark voltage of the latent images on the image bearing member.

6. The process as set forth in claim 1, wherein the frequency of the A.C. electrical field is less than 20,000 Hz.

* * * * *